US005763812A

United States Patent [19]

Collins

[11] Patent Number: 5,763,812

[45] Date of Patent: Jun. 9, 1998

[54] COMPACT PERSONAL RAIL GUN

[76] Inventor: Galen Collins, 2595 Mount Pleasant Rd., San Jose, Calif. 95148

[21] Appl. No.: 544,988

[22] Filed: Oct. 30, 1995

[51] Int. Cl.[6] ..... F41F 1/00

[52] U.S. Cl. ..... 89/8; 124/3

[58] Field of Search ..... 89/8; 124/3

[56] References Cited

U.S. PATENT DOCUMENTS

| | | | |
|---|---|---|---|
| 1,565,895 | 12/1925 | Blaustein | 89/8 |
| 2,214,297 | 9/1940 | Ferry | 124/3 |
| 2,235,201 | 3/1941 | Cole | 124/3 |
| 3,611,783 | 10/1971 | Mittelmann | 89/8 |
| 4,926,741 | 5/1990 | Zabar | 124/3 |

FOREIGN PATENT DOCUMENTS

| | | | |
|---|---|---|---|
| 2250803 | 4/1974 | Germany | 89/8 |
| 2460507 | 7/1976 | Germany | 89/8 |
| 517295 | 2/1955 | Italy | 89/8 |

*Primary Examiner*—Stephen M. Johnson
*Attorney, Agent, or Firm*—Allston L. Jones

[57] ABSTRACT

A compact bearing ball, or rail, gun to magnetically accelerate ferro-magnetic BBs is disclosed. The gun comprises a main board containing a channel sized to allow smooth passage of a BB, a straight portion of that channel forming a barrel terminating at an edge of the main board. A plurality of wire coils are disposed perpendicular to the axis of the barrel collinear with that axis. Driver circuitry for inducing in the plurality of wire coils is provided to ensure a synchronized generation of magnetic fields in individual ones of the wire coils to accelerate ferro-magnetic BBs disposed within the channel of the main board through the channel and out of the barrel. In a preferred embodiment, the channel has a loading segment substantially perpendicular to the barrel for aligning ferro-magnetic BBs prior to acceleration through the barrel, along with a magnet at the intersection of the loading segment and the barrel for positioning a BB co-centric with the axis of said barrel prior to acceleration.

15 Claims, 6 Drawing Sheets

COMPACT PERSONAL RAIL GUN

BACKGROUND OF THE INVENTION

Field of Invention

This invention relates to portable low power or bearing ball (BB) guns, and more particularly to a compact and portable rail gun for accelerating magnetically susceptible spherical balls or BBs.

BACKGROUND ART AND RELATED ART DISCLOSURES

Compressed air powered rifles and pistols, known as "BB guns", have been known and in widespread use for many years. These guns operate by propelling the "BB" using the force of expansion of pressurized air. The air becomes pressurized typically by pumping the air reservoir using a hand pump incorporated into the gun.

Unfortunately, pumping such a gun is a time consuming and physically taxing activity, which both significantly diminishes the rate at which the gun may be fired and tires the user from the tedious, and demanding pumping of the gun. Furthermore, these guns are noisy, due to the sound of the rapidly expanding pressurized air.

One method which may be used to accelerate ferro-magnetic metallic balls is through the use of changing magnetic fields. Such an accelerator, known as a "rail gun", has previously been considered for accelerating payloads into space, either from an earth-bound or extraterrestrial location. Such attempts have proven unsuccessful at creating devices which can accelerate large payloads at high speeds with practical energy usage.

However, smaller rail guns could theoretically be used to accelerate ferro-magnetic balls such as BBs. Unfortunately, such a rail gun would require expenditures of large energy. In addition, it is difficult to properly actuate the individual magnets of the rail gun to accelerate the BB. Finally, it is difficult to constrain the BB to following an appropriate trajectory within the rail gun while permitting free motion along the desired trajectory.

Hence, it would be advantageous to provide a portable rail gun capable of accelerating metallic balls and which uses conventional portable power sources such as batteries. Such a rail gun should align and guide the balls with minimal assistance from the operator.

SUMMARY OF THE INVENTION

The present invention comprises a compact rail gun for magnetically accelerating ferro-magnetic balls. The gun comprises a printed circuit board containing a channel sized to allow smooth passage of a BB. A straight portion of the channel serves as a barrel terminating at an edge of the printed circuit board. A plurality of wire coils are disposed perpendicular to the axis of the barrel, the centers of the wire coils being substantially collinear with that axis. The gun further has driver circuitry for inducing in the wire coils a synchronized generation of magnetic fields in individual ones of the wire coils to accelerate ferro-magnetic balls disposed within the barrel of said circuit board through said barrel and out of the circuit board.

In a presently preferred embodiment of the present invention, the rail gun's channel further has a loading segment substantially perpendicular to the barrel for aligning ferro-magnetic balls prior to acceleration through the barrel. The gun further includes a magnet disposed at the intersection of the loading segment and the barrel for positioning a BB co-centric with the axis of the barrel prior to acceleration.

The driver circuitry described above may include a controller, preferably a microprocessor. It may further comprise a coil driver circuit connected to the controller with a plurality of high side drivers and a plurality of low side drivers, the high side drivers and the low side drivers being disposed to create an array of circuit nodes, each of the circuit nodes being connected to a distinct one of the wire coils, such that no two adjacent wire coils are attached to the same high side driver nor to the same low side driver. The circuit has an electrical energy storage element connected to the wire coils through the high side drivers, that element preferably being a capacitor. BB position location circuitry is included and connected to the low side drivers and to the controller for identifying the location of the BB being accelerated through the barrel and communicating that location to the controller. The low side drivers are connected to an electrical potential of significantly lower voltage than that stored in the electrical energy storage device. Also, an electrical charger is connected to the controller and to the electrical energy storage element for charging the electrical energy storage element. Finally, a trigger actuator is connected to the controller for initiating acceleration of a BB through the barrel.

DETAILED DESCRIPTION OF THE PRESENT INVENTION

Figure 1A:
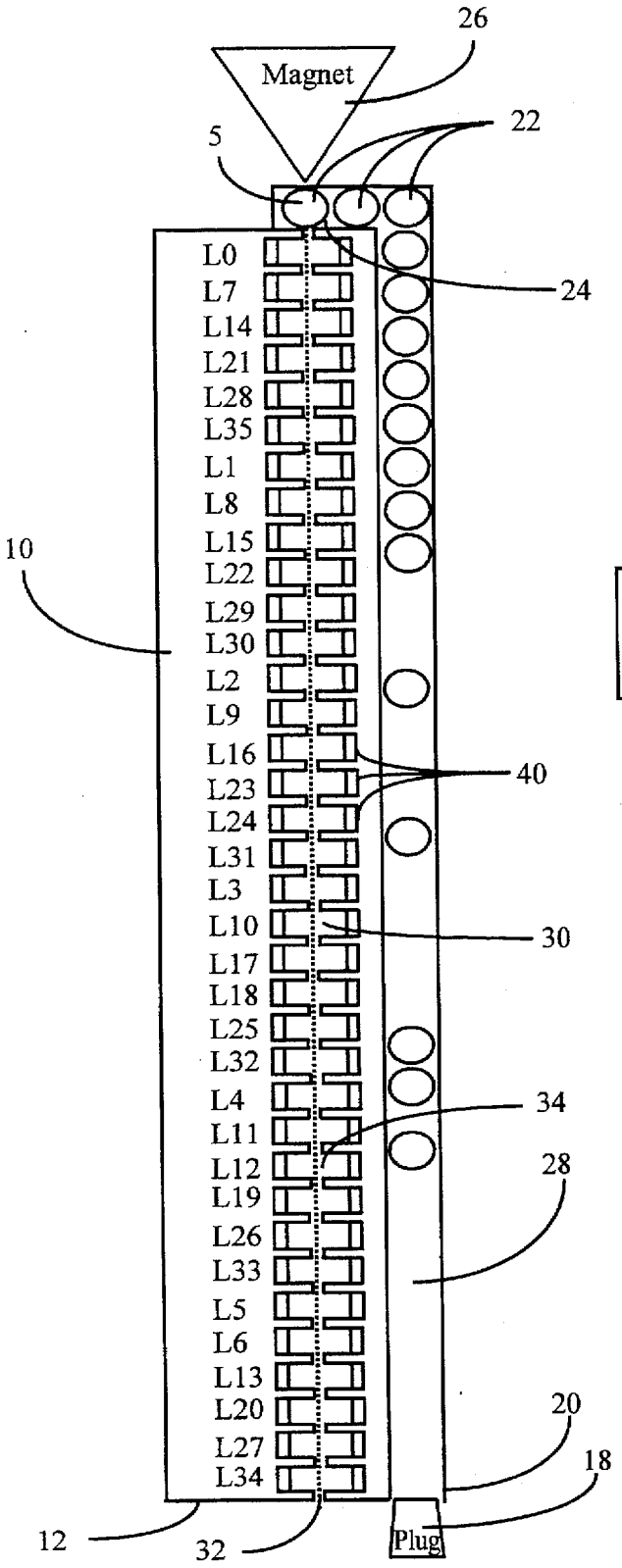
FIG. 1*a* is a top view of a section of an embodiment of a rail gun according to the present invention, illustrating the physical structure of the coil and BB loading assemblies.

The internal mechanical structure of a presently preferred embodiment of the present invention is illustrated in FIG. 1*a*. As shown here, a main board 10 includes three major mechanical components: an "L" shaped BB tube 28, a magnet 26, and an electromagnetic barrel 30, with each of tube 28 and barrel 30 having an interior size that allows the smooth passage of ferro-magnetic BBs 5 therethrough.

BB tube 28 provides storage for a number of BBs 5 in a single line for firing. BBs 5 are loaded into tube 28 via opening 20 with plug 18 inserted into opening 20 to retain BBs 5 within tube 28. Ferro-magnetic BBs 5 progress through tube 28 toward the substantially 90° bend and therearound to position 24 where magnet 26 holds one BB 5 in place ready for firing.

Electromagnetic barrel 30 is constructed of a row of a plurality of linearly arranged, concentric, substantially same sized and spaced apart electromagnetic coils 40 that extend substantially from magnet 26 at point 24 to point of BB ejection 32. Further, barrel 30 has a central axis 34, which plays an important role in synchronizing the acceleration of BB 5 through barrel 30 as will be seen in the following discussion.

Figure 1B:
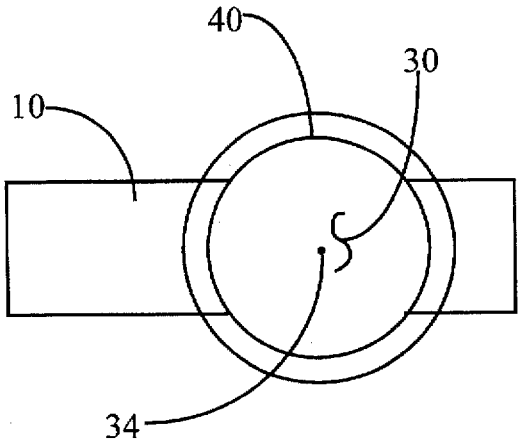
FIG. 1*b* is a "down the barrel" view of the segment of the rail gun of FIG. 1*a* from the viewpoint facing into the barrel of the gun.

A number of coils 40 (shown in cross-section in FIG. 1*b*), a total of 36 coils being shown in the embodiment illustrated in FIG. 1*a*, are disposed on main board 10, defining central axis 34 of barrel 30 through the center of each of coils 40. While coils 40 are shown equally spaced one from the other, this is not essential to the operation of the present invention, although it does yield the best acceleration to produce the highest exit speed of the BB 5 being expelled.

Figure 2A:
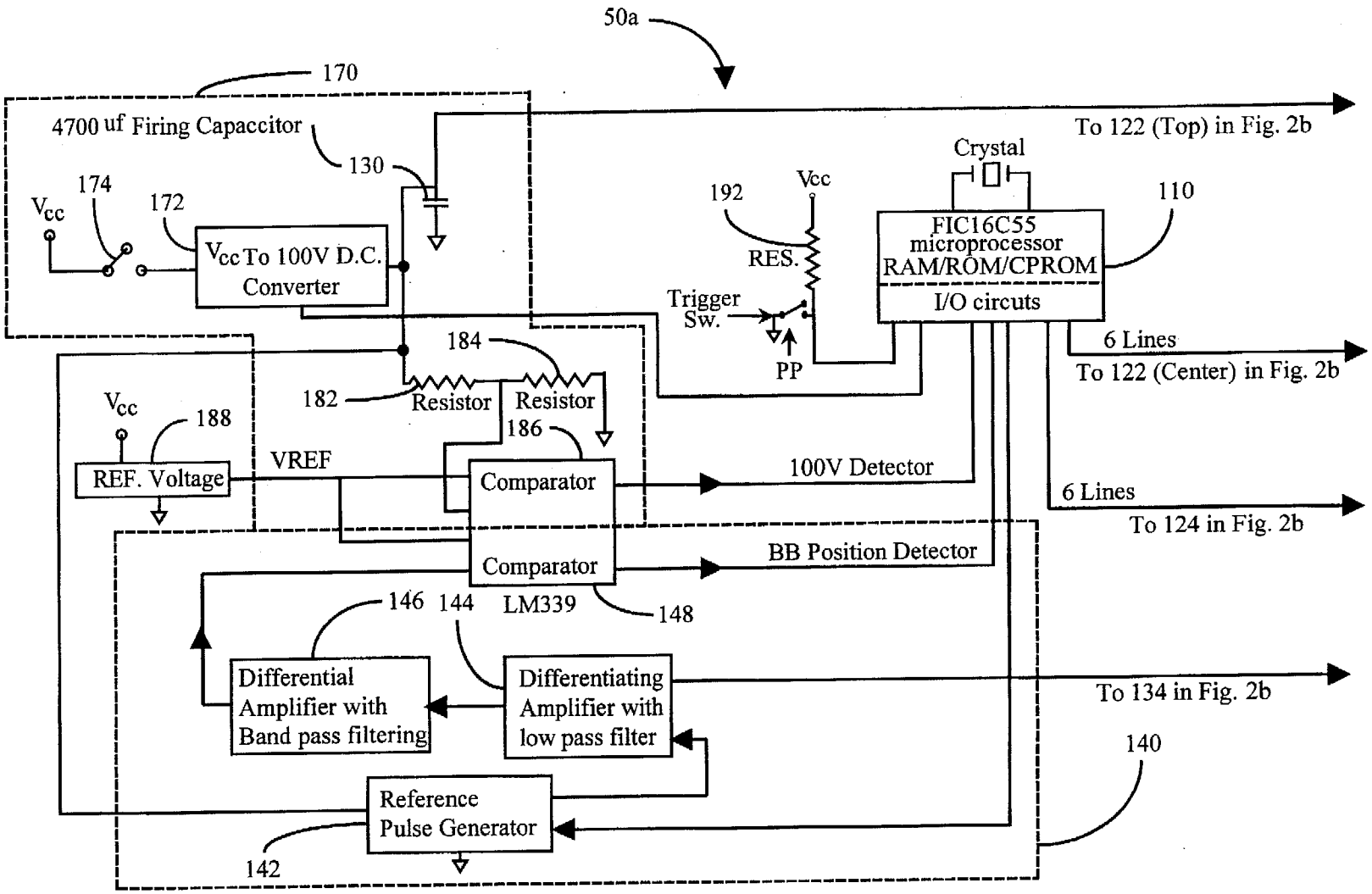
FIGS. 2*a* and 2*b* together are a schematic diagram of a driver circuit for controlling the magnetization of the coils of the rail gun of FIGS. 1*a* and 1*b*.
Figure 2B:
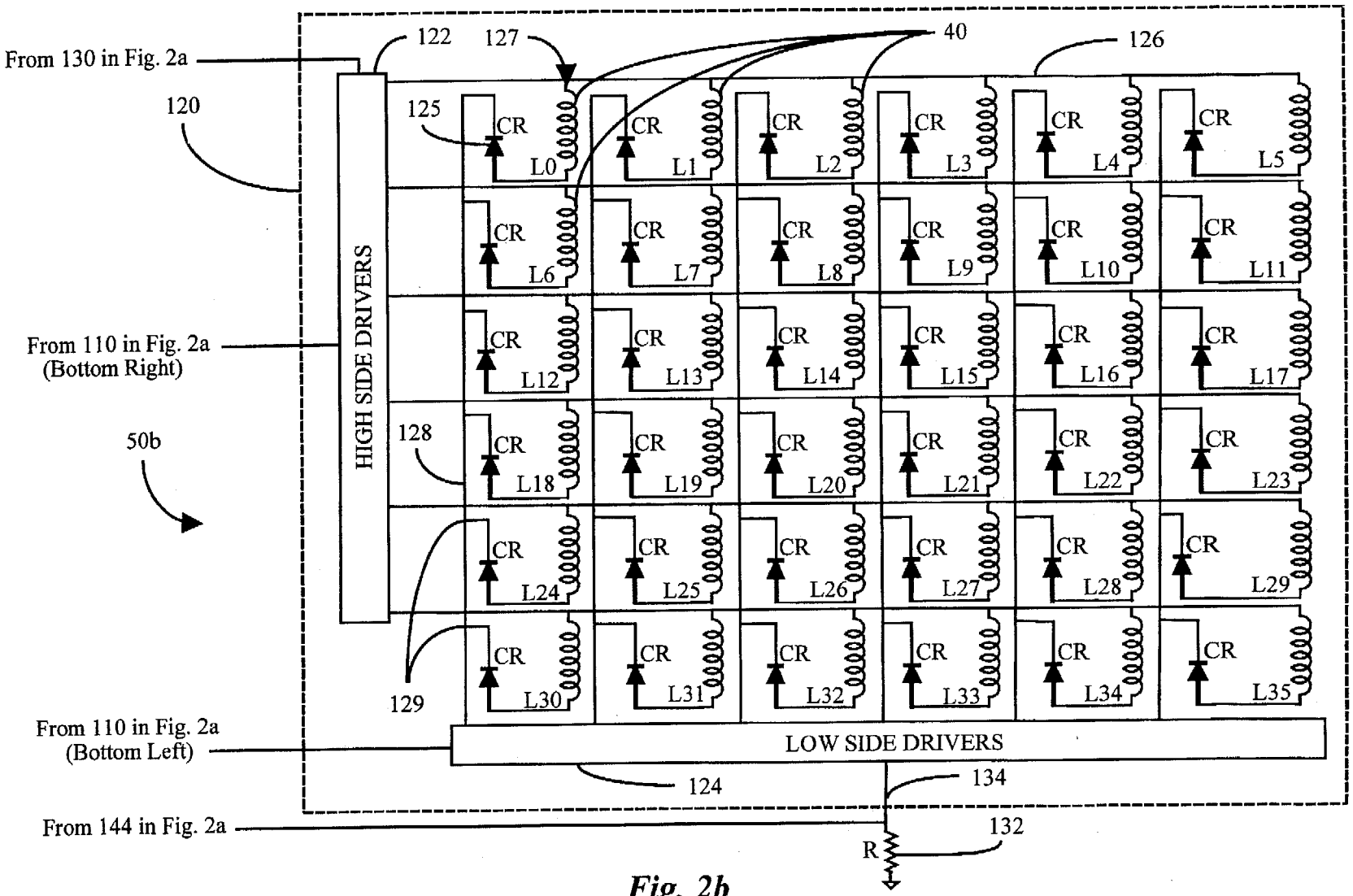

Also located on main board 10 is driver circuit 50*a* and 50*b* (not shown in FIG. 1*a*) illustrated separately in the combination of FIGS. 2*a* and 2*b* . For purposes of orientation, coils 40 as shown in FIG. 1*a* are shown in a matrix configuration in the the schematic diagram of FIG. 2*b* as a portion of coil driver circuit 120. Additionally, since tube 28 and magnet 26 are not electronic components they are not shown in FIGS. 2*a* and 2*b*.

In the combination of FIGS. 2*a* and 2*b* , driver circuit 50*a* and 50*b* of the present invention is shown divided into several functional portions, namely, controller 110, coil driver circuit 120, position location circuit 140 and electrical charge and firing circuit 170.

The function of driver circuit 50*a* and 50*b* is to sequentially induce in inductive coils 40, that form barrel 30, a synchronized generation of a magnetic field to accelerate ferro-magnetic BBs 5 through individual coils 40 of barrel 30 and to expel them from point of ejection 32 by the synchronization of the creation of magnetic fields in coils 40. Referring again to FIG. 1*a*, first, a current is introduced into a first coil 40, $L_0$, inducing a magnetic field within coil $L_0$. That magnetic field in coil $L_0$thus magnetically plucks the next BB 5 from injection point 24 and draws it away from magnet 26 into the center of coil $L_0$, thus performing the first acceleration step on BB 5.

Then, as BB 5 reaches the center of coil $L_0$, current is removed from coil $L_0$, the field collapses, and a current is introduced in the next coil, $L_7$ (the numbering of the coils corresponds to the numbering of the coils in the matrix of coils 40 in the coil driver circuit 120 of FIG. 2 and the firing order that is discussed below in the specific discussion of the operation of driver circuit 50*a* and 50*b*), creating a new magnetic field within coil $L_7$. This new magnetic field then draws BB 5 along toward the center of coil $L_7$, further accelerating BB 5. By carefully timing the introduction of currents into each successive coil 40, BB 5 is repeatedly accelerated along barrel 30 and expelled from point of ejection 32.

Automatic loading of BBs 5 for injection into barrel 30 is accomplished as also shown in FIG. 1*a*. Tube 28 has a shorter loading segment 22 that is substantially perpendicular to barrel 30 that is provided to position and aligning BBs 5 with barrel 30 prior to acceleration with the next BB 5 to be fired held in position at injection point 24 by magnet 26.

The strength of magnet 26 is selected to extract the next BB 5 from loading segment 22 of tube 28 and to lightly hold that BB 5 at the injection point 24 prior to firing. Magnet 26 thus facilitates automatic loading of BBs 5 for firing, and decreases the possibility of jamming at the injection point 24 associated with simple mechanical loading of BBs 5 which might occur if coil $L_0$, when energized were to extract more than one BB 5 from tube 28.

Specifically, magnet 26 ensures that a properly disposed BB 5 is in place at injection point 24 when the firing sequence is initiated with BB 5 substantially co-linear with central axis 34 of barrel 30. Additionally, the strength of magnet 26 is chosen with a strength sufficient to ensure location of BB 5 at injection point 24, and not so strong as to prevent the magnetic field initiated in coil $L_0$ from drawing BB 5 into coil $L_0$ and beginning the passage through barrel 30.

Figure 3:
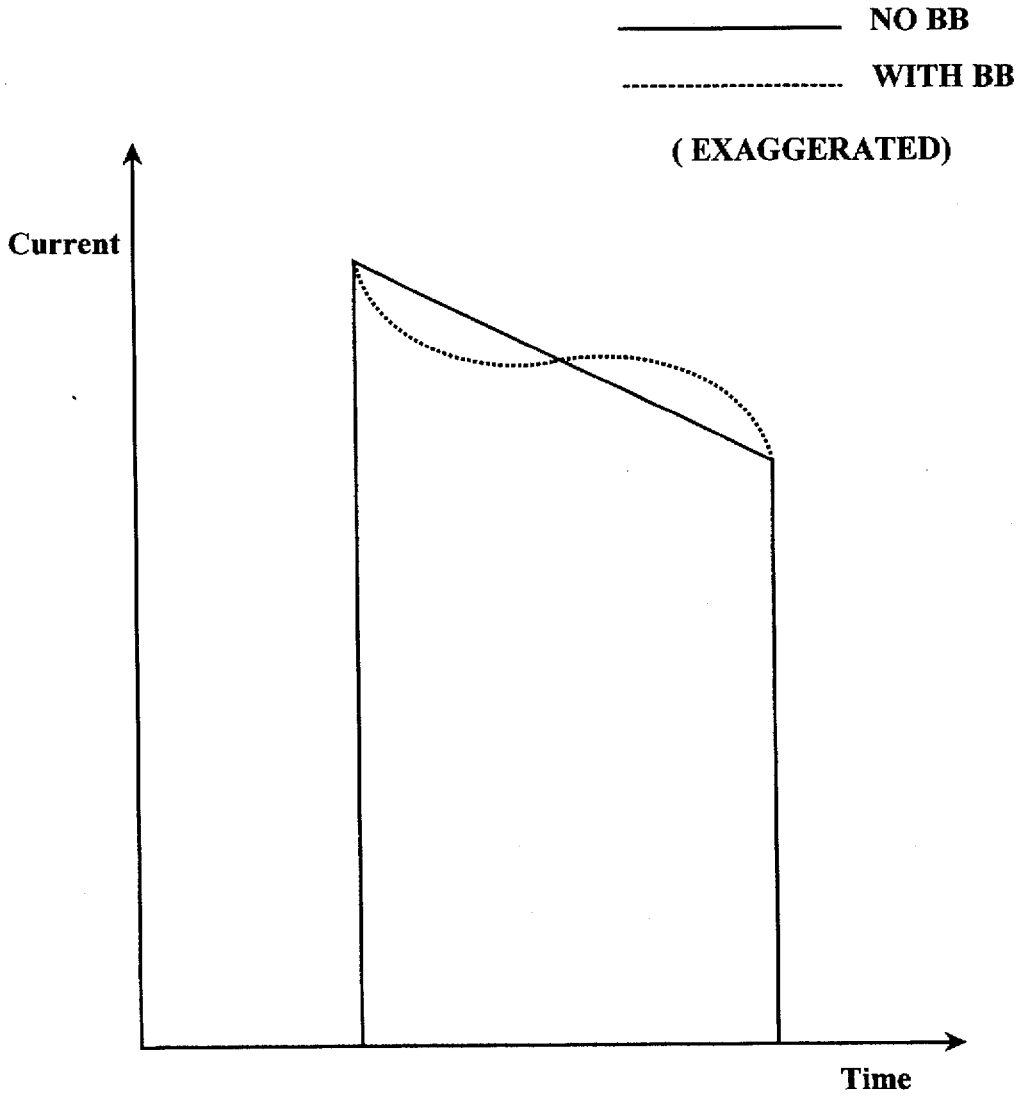
FIG. 3 illustrates a pulse through the wire coils of the rail gun with and without the presence of a BB.
Figure 4A:
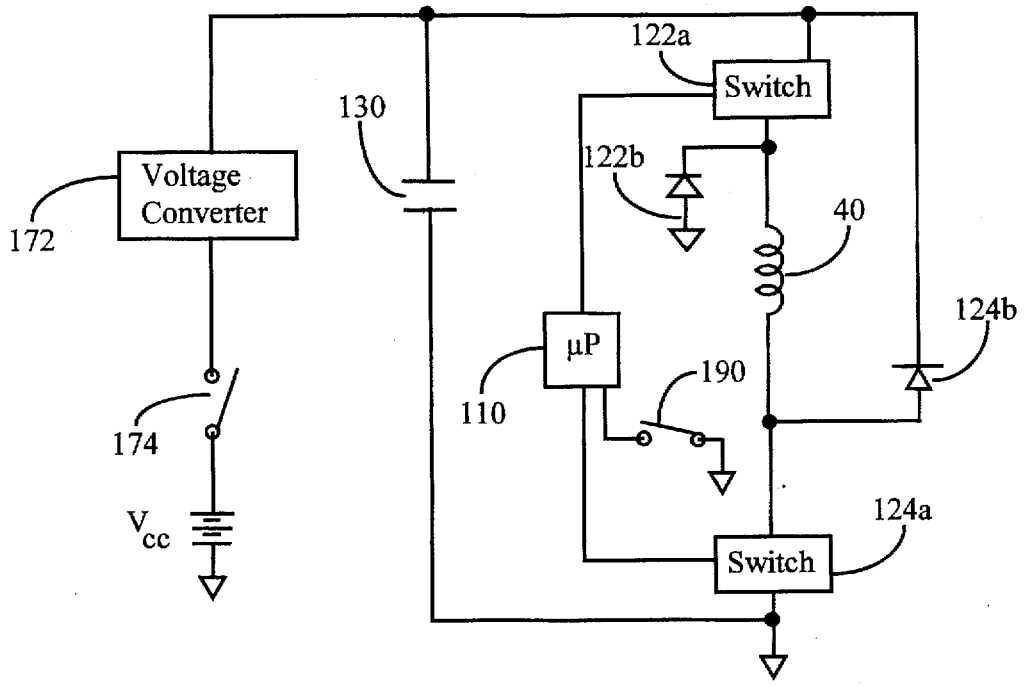
FIG. 4*a* is a simplified schematic diagram of the energization circuit for a single coil using the configuration of the present invention.

Before discussion in detail of the complete driver circuit 50 as shown in the combination of FIGS. 2*a* and 2*b* , a discussion of the operation in a simplified one coil circuit is offered with respect to FIG. 4*a*. Here there is shown a DC battery providing a voltage source, $VC_{cc}$ that is serially connected with an on/off switch 174 which when closed applies $V_{cc}$ to voltage converter 172 to generate a selected voltage (e.g., 100 V in the present embodiment) to which firing capacitor 130 is to be charged. Connected across capacitor 130, under control of high and low side switches 122*a* and 124*a*, respectively, is inductive coil 40. Controlling the closure of high and low side switches 122*a* and 124*a* is a controller 110 with the time of firing being manually selected by user closure of switch, or trigger, 190 to activate controller 110. When switches 122*a* and 124*a* are closed, current flows through coil 40 from capacitor 130 to the return terminal (i.e., top to bottom in this view) and in so doing partially depletes the charge on capacitor 130 faster than voltage converter 172 can replenish that charge. The waveform of the current through capacitor 130 and coil 40 during that process is as shown in solid lines in FIG. 3.

When switches 122*a* and 124*a* are closed, diodes 122*b* and 124*b* are reversed biased and therefore not conducting (i.e., the voltage on the anode of diode 122*b* is 100 V and the voltage on the anode of diode 124*b* is zero). However, when switches 122*a* and 124*a* are opened, since it is the nature of inductors to continue to conduct in the direction in which they had been conducting, diodes 122*b* and 124*b* are now forward biased thus conveying the energy from the collapsing field of coil 40 to capacitor 130 through diode 124*b* to partially recharge capacitor 130.

Figure 4B:
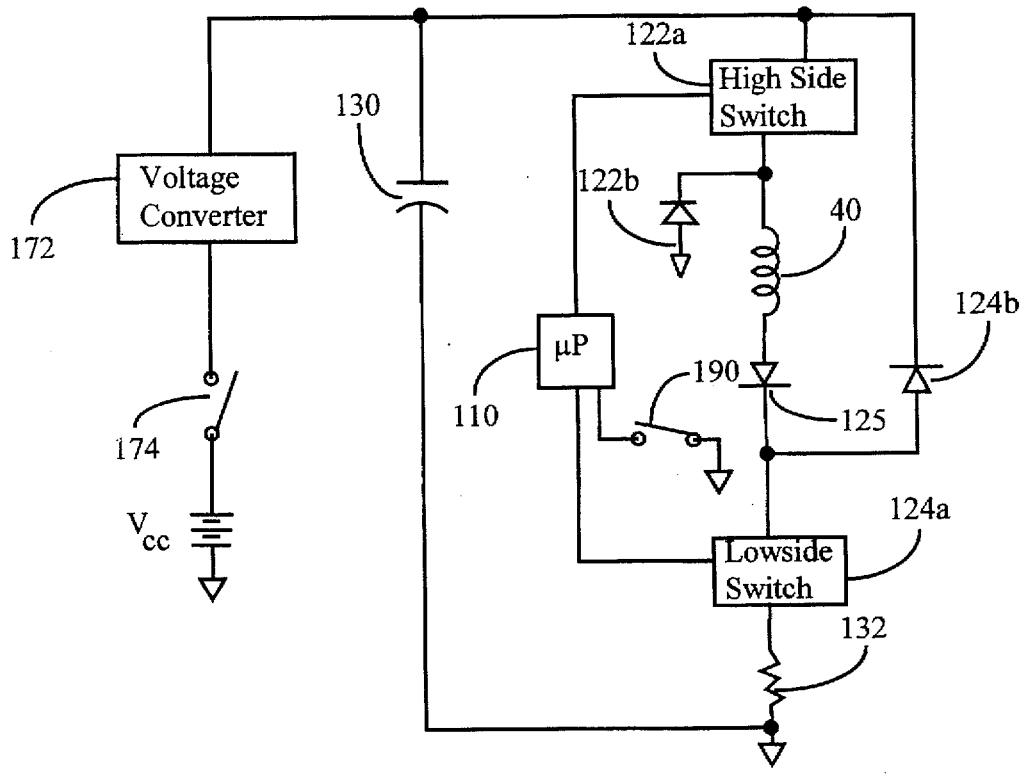
FIG. 4*b* is a simplified schematic diagram of FIG. 4*a* that incorporates the single coil energization diode and the coil current monitoring resistor for the multiple coil configuration of the present invention.

In actual operation two additional components need to be added to the simplified view as shown in FIG. 4*b*. There are two components that have been added, namely, current sensor resistor 132 and diode 125. Current sensor resistor 132 has been added to enable the monitoring of the current flow through coil 40 so that determination can be made as to the presence or non-presence of a BB 5 within coil 40 as is discussed below. Diode 125 has been added in series with coil 40 to prevent the flow of current through more than one coil 40 at a time in the matrix configuration of the combination of FIGS. 2*a* and 2*b* as is discussed further below.

Again referring to the combination of FIGS. 2*a* and 2*b* , for purposes of orientation of the differently named components here and in FIGS. 4*a* and 4*b*, high side switch 122*a* and diode 122*b* make up a portion of the plurality of drivers in high side drivers 122, and similarly, low side switch 124*a* and diode 124*b* make up a portion of the plurality of drivers in low side drivers 124.

Central to the operation of the rail gun of the present invention is controller 110 that is responsible for the operational timing of most of the elements of driver circuit 50*a* and 50*b* and can be implemented, for example, with a 3PIC16C55 microcomputer, together with corresponding RAM, EPROM, and input/output (I/O) circuitry.

Another important component to the functioning of driver circuit 50*a* and 50*b* is electrical charge circuit 170, and specifically the energy storage element, firing capacitor 130 (e.g., 4700 μF in the preferred embodiment). As seen here and in FIGS. 4*a* and 4*b*, firing capacitor 130 is connected across high and low side drivers 122 and 124, respectively, and hence selectively in series with inductive coils 40 one at a time.

In order to charge firing capacitor 130 between firing sequences, a $V_{cc}$ to 100 V converter 172, under control of controller 110, is connected to firing capacitor 130. To monitor the voltage level to which capacitor 130 is charged, a voltage divider consisting of serial connected resistors 182 and 184 is connected across capacitor 130 and the tap between resistors 182 and 184 is connected to one input terminal of comparator 186. Additionally, a reference voltage generator 188 is provided to generate the equivalent of the voltage that is present at the tap between resistors 182 and 184 when capacitor 130 is charged to the selected maximum voltage which is 100 V in the example given above, and the output of voltage generator 188 is connected to the second input terminal of comparator 186. Thus, comparator 186 provides an input signal to controller 110 when the two input signals thereto match, thus indicating that the charge on capacitor 130 has reached 100 V in this example. When that has occurred, controller 110 turns converter 172 off to not over charge capacitor 130.

Also, a trigger switch 190, which the equivalent of the gun trigger for the user to actuate the firing of a BB 5, is connected between controller 110 and return with the controller terminal also being connected to pull-up resistor 192 to $V_{cc}$ do that the terminal of controller 110 is connected to return when trigger switch 190 is closed. When switch 190 is closed, controller 110 detects that signal change and interprets the transition as an operation request for initiation of the firing process, i.e., acceleration of BB 5 through barrel 30.

Driver circuit 50*a* and 50*b* also contains coil driver circuit 120 that is connected to controller 110 for selectively energizing and de-energizing selected ones of the inductive coils 40 in order, as deployed (see FIG. 1*a*) from magnet 26 to point 32, to accelerate BBs 5, as described above. In order to do so coil driver circuit 120 contains a plurality of high side drivers 122 and a plurality of low side drivers 124, with the high side drivers shown here selectively controlling the connection of the positive terminal of capacitor 130 to the horizontal conductors 126 in the matrix of coils 40, and the low side drivers 124 connected to resistor 132 and the vertical conductors 128 in the matrix of coils 40 to define an array of circuit nodes horizontally and vertically, each circuit node being connected to a distinct one of coils 40 and combination of horizontal and vertical conductors 126 and 128, respectively.

Specifically, each high side driver 122 is connected to a high side conductor 126, which is attached to a series of nodes 127 with distinct ones of coils 40. Each low side driver 124 is connected to a low side conductor 128, which is connected at a series of nodes 129 to the cathode of a plurality of series of diodes 125. The anode of each diode 125 is serially connected to a corresponding one of coils 40. In this manner each high side driver 122 is connected to a plurality of coil 40—diode 125 serial connections, with each coil/diode combination in turn connected to a low side driver 124.

These connections are made such that no two coils 40 are attached to the same combination of high and low side drivers 122 and 124, respectively. In this manner, selection of a one high side driver 122 and one low side driver 124 uniquely specifies an individual coil 40 for activation. Furthermore, the connections are chosen such that no two adjacent coils 40 (as per deployment shown in FIG 1*a*) are attached to the same high side driver 122 nor to the same low side drivers 124. This arrangement of coils 40 is recommended for the reclamation of electrical energy from coils 40 to the firing capacitor 130 when high and low side drivers are deactivated as explained above with respect to FIGS. 4*a* and 4*b*.

Additionally, note that in FIG. 1*a* the coil 40 positions are labelled $L_0$, $L_7$, $L_{14}$, etc., and in FIG. 2 the individual coils are numbered 0–5 in the top row, 6–11 in the second row, 12–17 in the third row, etc. down to 30–35 in the bottom row. As discussed briefly with respect to FIG. 4*b*, diode 125 is provided in series with coil 40 to prevent the energizing of multiple coils when one combination of high and low side drivers 122 and 124 are energized. For example in FIG. 2*b* if the left most vertical driver line 128 and the top most horizontal driver line 126 are each energized, it is coil $L_0$, the one in the top left corner that is to be energized. However, if diodes 125 were not present there would be multiple other multiple coil paths that would also be energized. For example, there would also be a current path from the top horizontal driver line 126, through coil $L_1$, to the second vertical driver line 128, to coil $L_7$, to the second horizontal driver line 126, to coil $L_6$, to the left most vertical driver line 128 in parallel with coil $L_0$.

Another feature of the present invention is the BB 5 position location circuit 140. As illustrated in FIG. 3, the shape of the current waveform of a coil 40 in the presence of a BB 5 (broken line) differs slightly (the difference is exaggerated in FIG. 3 for clarity) from that in the absence of a BB 5 (solid line). To detect that difference, position location circuit 140 was devised. To do so, reference pulse generator 142 that generates a pulse that resembles the solid line pulse shown in FIG. 3 under control of controller 110, supplies that generated reference current pulse to one input terminal of differential amplifier 144. The second input signal to differential amplifier circuit 144 is provided by resistor 132 that is serially connected between low side drivers 124 and return with the current through resistor 132 being the current that flows through the particular one of coils 40 that has been energized, thus having the solid line shape of the pulse in FIG. 3 if no BB 5 is present in the then energized coil 40, or the broken line shape of the pulse in FIG. 3 if a BB 5 is present in the then energized coil 40. Thus the output signal from differential amplifier 144 is the difference between the actual signal on the energized coil 40 and the signal from reference pulse generator 142, i.e. the ripple on the top of the signal in FIG. 3. That ripple signal is then applied to differentiating amplifier and low pass filter 146 and then to comparator 148 where it is compared to a reference voltage from reference voltage generator 188. Since the ripple signal extracted from the signal on coil 40 does not indicate specifically when BB 5 is centered in coil 40, the signal from either or both of reference pulse generator 142 and reference voltage generator 188 is adjusted in practice to maximize the velocity of BBs 5 being expelled from barrel 30.

For practical reasons, the step performed by the differential amplifier is performed in two steps. A first step by differential amplifier and bandpass filter 144 to grossly determine the ripple on the current pulse (see FIG. 3) and eliminate artifacts due to DC offsets between the reference pulse and the detected waveform from resistor 132, as well as noise and other artifacts with the bandpass center frequency chosen to correspond to the roughly sinusoidal difference signal illustrated in FIG. 3. This may be easy implemented in an operational amplifier-based configuration by an appropriate use of resistor-capacitor networks, as is well known in the art. However, the bandpass filter may be configured as a separate element in alternative embodiments without sacrificing the functionality of the system.

The output signal from differential amplifier/bandpass filter 144 is then connected to the input terminal of differentiating amplifier 146 which is combined with a low pass filter in the embodiment illustrated in FIG. 2*a* and may be constructed from a standard operational amplifier with an properly configured resistor-capacitor network. The output signal of differentiating amplifier/low-pass filter 146 is indicative of transitions of the difference signal between the reference signal and the measured signal from coils 40 which in turn is applied to one input of comparator 148, and compared with the reference voltage threshold output from reference voltage generator 188. Again, comparator 148 may be a standard operational amplifier. The output of comparator 148 then serves as a BB position detection signal, and is input to controller 110.

This location information is then used by controller 110 to establish the timing of the activation and deactivation of current through subsequent coils 40 as BB 5 travels down barrel 30 at an accelerating pace.

Now that the basic connection and operation of each of the component sections of the rail gun of the present invention have been described the synchronization of the magnetic fields in the plurality of coils 40 can be addressed. First, a current is introduced into a first coil 40, identified as $L_0$, by activating the first high side driver 122 and the first low side driver 124. This creates a closed circuit between the high voltage on the positive terminal of firing capacitor 130, coil $L_0$, and return through low side driver 124. The potential difference between firing capacitor 130 and return thus causes a current flow, which induces a magnetic field within coil $L_0$ .

The next one of BBs 5 being held by magnet 26 is magnetically attracted by that field, which pulls BB 5 towards the center of coil $L_0$, thus accelerating BB 5. Then, as BB 5 reaches the center of coil $L_0$, current is removed from coil $L_0$, the field collapses, and a current is introduced into the next coil, coil $L_7$, creating a new magnetic field within coil $L_7$. This new magnetic field then draws BB 5 along toward the center of coil $L_7$, further accelerating BB 5. By carefully timing the introduction of currents into the remaining coils 40, BB 5 may be repeatedly accelerated along barrel 30 and past the point of ejection 32 with the timing being coordinated by controller 110, considering the output of comparator 148.

One of the key advantages of the present invention results from the use of firing capacitor 130 and coil driver circuit 120. Since each coil 40 is successively charged and discharged, diodes 122*b* and 124*b* recapture the energy from the collapsing field in coil 40 and return it to firing capacitor 130, thus slowing the rapid collapse of the capacitor voltage while also protecting the drivers from high voltage spikes that can damage them if not checked. This efficiency decreases the total energy which must be stored in the system to initiate firing.

As will be understood by those familiar with the art, the present invention may be embodied in other specific forms without departing from the spirit or essential characteristics thereof. The scope of the present invention is therefore limited only by the scope of the claims appended hereto.

What is claimed is:

1. A compact rail gun to electro-magnetically accelerate ferro-magnetic balls, said gun comprising:

a main board containing a channel sized to allow smooth passage of individual ones of said ferro-magnetic balls, a straight portion of said channel comprising a barrel, said straight barrel having a central axis;

a plurality of wire coils disposed perpendicular to said axis of said barrel, said wire coils all having centers substantially collinear with said axis of said barrel; and driver circuitry to sequentially induce in said plurality of wire coils a magnetic field in individual ones of said wire coils to accelerate individual ones of said ferro-magnetic balls disposed within said channel of said main board through and out of said barrel, wherein said driver circuitry comprises:

a controller;

a coil driver circuit connected to said controller comprising a plurality of high side drivers and a plurality of low side drivers, said high side drivers and said low side drivers disposed to create an array of circuit nodes, each of said circuit nodes being connected to a distinct one of said wire coils;

an electrical energy storage element connected to said wire coils through said high side drivers;

an electrical charger connected to said controller and to said electrical energy storage element to charge said electrical energy storage element; and a trigger actuator connected to said controller to initiate acceleration of said ball through said barrel.

2. The rail gun of claim 1 wherein:

said channel further comprises a loading segment at an angle to said barrel to align said ferro-magnetic balls prior to acceleration through said barrel; and said rail gun further comprises a magnet disposed at the intersection of said loading segment and said barrel to position one of said balls co-centric with said axis of said barrel prior to acceleration.

3. The rail gun as in claim 2 wherein said loading segment is substantially perpendicular to said barrel.

4. The rail gun as in claim 1 wherein no two adjacent ones of said wire coils is attached to the same one of said high side drivers nor to the same one of said low side drivers.

5. The rail gun as in claim 1 wherein said low side drivers are connected to an electrical potential of significantly lower voltage than that stored in said electrical energy storage device.

6. The rail gun of claim 1, wherein said electrical energy storage element comprises a capacitor.

7. The rail gun of claim 1, wherein said controller comprises a microcomputer.

8. The rail gun as in claim 1 wherein said driver circuitry further comprises a ferro-magnetic ball position location circuitry connected to said low side drivers and to said controller to identify the location of said ball being accelerated through said barrel and communicating that location to said controller.

9. The rail gun of claim 8, wherein said ball position location circuitry comprises:

a reference pulse generator;

a resistor connected in series with said low side drivers;

a differential amplifier having two input terminals, one of said differential amplifier input terminals being connected to said reference pulse generator and the other of said differential amplifier input terminals being connected to the said resistor to generate a difference signal representing the difference in signals generated by said reference pulse generator and said low side drivers;

a reference voltage generator to generate a reference voltage; and a comparator having two input terminals, one of said comparator input terminals being connected to said differential amplifier to receive said difference signal and the other of said comparator input terminals being connected to said reference voltage generator to compare said reference voltage with the output of said differential amplifier to generate a signal indicating when said ball is centered in said energized coil.

10. The rail gun of claim 9, wherein said ball position location circuitry further comprises:

a bandpass filter coupled to said differential amplifier to filter said difference signal;

a differentiating amplifier having an input terminal and an output terminal, said input terminal being connected to receive said band pass filtered signal from said differential amplifier; and a low pass filter coupled to said differentiating amplifier to minimize higher frequency signal components from the difference signal applied to said comparator.

11. A method for electro-magnetically accelerating ferro-magnetic balls with a compact rail gun defining a channel sized to allow smooth passage of individual ones of said ferro-magnetic balls with a straight portion of said channel comprising a barrel having a central axis and a plurality of wire coils disposed perpendicular to said axis of said barrel with said wire coils all having centers substantially collinear with said axis of said barrel, a plurality of high side drivers and a plurality of low side drivers, said high side drivers and said low side drivers disposed to create an array of circuit nodes, each of said circuit nodes being connected to a distinct one of said wire coils and an electrical energy storage element connected to said wire coils through said high side drivers, said method comprising the step of:

a. presenting individual ones of said balls for acceleration; and b. sequentially inducing a magnetic field in each of said plurality of wire coils to accelerate individual ones of said ferro-magnetic balls disposed within said channel through and out of said barrel by individually energizing said wire coils by selectively activating various ones of said high and low side drivers associated with the same wire coil.

12. The method of claim 11, said channel including a loading segment at an angle to said barrel to align said ferro-magnetic balls prior to acceleration through said barrel, said method further including the steps of:

c. magnetically separating the next ferro-magnetic ball to be accelerated from said loading segment; and d. positioning said next ball co-centric with said axis of said barrel prior to acceleration.

13. The method of claim 12 wherein said loading segment is substantially perpendicular to said barrel.

14. The method of claim 11 further includes the step of:

e. determining the location of said magnetic ball by comparing the typical signal on a wire coil without a ball present in said coil with the signal on said coil to detect a difference signal which when present indicates the location of said ball within said coil.

15. The method of claim 14 wherein step e. comprises the steps of:

f. generating a reference pulse that is representative of the signal on said wire coil when said ball is not present within said coil;

g. monitoring the actual signal on said coil;

h. subtracting said signals of steps f. and g. from each other to generate a signal representing the presence of said ball within said coil.

* * * * *